US011022340B2

(12) United States Patent
Wilson et al.

(10) Patent No.: US 11,022,340 B2
(45) Date of Patent: Jun. 1, 2021

(54) ENHANCED HEAT TRANSFER SURFACES FOR HEAT EXCHANGERS

(71) Applicant: Johnson Controls Technology Company, Milwaukee, WI (US)

(72) Inventors: Stephen C. Wilson, Oklahoma City, OK (US); David C. Rimmer, Newcastle, OK (US); Raul G. Guajardo, Oklahoma City, OK (US)

(73) Assignee: Johnson Controls Technology Company, Auburn Hills, MI (US)

( * ) Notice: Subject to any disclaimer, the term of this patent is extended or adjusted under 35 U.S.C. 154(b) by 248 days.

(21) Appl. No.: 15/645,875

(22) Filed: Jul. 10, 2017

(65) Prior Publication Data

US 2018/0031274 A1 Feb. 1, 2018

Related U.S. Application Data

(60) Provisional application No. 62/369,553, filed on Aug. 1, 2016.

(51) Int. Cl.

| | |
|---|---|
| ***F24H 3/08*** | (2006.01) |
| ***F28F 1/12*** | (2006.01) |
| ***F28F 13/06*** | (2006.01) |
| ***F28F 1/24*** | (2006.01) |
| ***F28D 1/047*** | (2006.01) |
| *F28D 21/00* | (2006.01) |

(52) U.S. Cl.

CPC ..... *F24H 3/087* (2013.01); *F28D 1/0477* (2013.01); *F28F 1/12* (2013.01); *F28F 1/126* (2013.01); *F28F 1/24* (2013.01); *F28F 13/06* (2013.01); *F28D 2021/0024* (2013.01); *F28F 2265/10* (2013.01)

(58) Field of Classification Search

CPC ..... F28F 1/24; F28F 1/12; F28F 13/06; F28F 2265/10; F28F 1/126; F24H 3/087; F28D 1/0477; F28D 2021/0024

USPC ..... 126/110 R–110 E, 99 R; 431/326–329, 431/354–355

See application file for complete search history.

(56) References Cited

U.S. PATENT DOCUMENTS

| | | | |
|---|---|---|---|
| 2,978,797 | A | 4/1961 | Ekelund |
| 3,154,141 | A | 10/1964 | Huet |
| 3,295,599 | A | 1/1967 | Okamoto et al. |
| 3,749,156 | A | 7/1973 | Fletcher et al. |

(Continued)

*Primary Examiner* — David J Laux
*Assistant Examiner* — Nikhil P Mashruwala
(74) *Attorney, Agent, or Firm* — Fletcher Yoder, P.C.

(57) ABSTRACT

A furnace system includes a burner assembly that includes a burner configured to produce a flame and a heat exchanger that includes a plurality of tube passes. The plurality of tube passes cooperatively forms a conduit for flowing combustion products generated by the burner assembly. Each tube pass of the plurality of tube passes overlaps with other tube passes of the plurality of tube passes. A first tube pass of the plurality of tube passes is configured to receive the flame, and the first tube pass includes a first plurality of surface enhancements extending radially outward from an outer surface of the first tube pass relative to a central axis of the first tube pass. The furnace system also includes a baffle that is coupled to the burner assembly, extends toward the first tube pass, and is configured to contact the flame and the first tube pass.

22 Claims, 12 Drawing Sheets

(56) References Cited

U.S. PATENT DOCUMENTS 3,828,762 A * 8/1974 Duzey ..... F24H 3/087 126/91 A
4,019,511 A * 4/1977 Choporis ..... A62B 9/003 128/203.26
4,657,074 A * 4/1987 Tomita ..... F24H 3/065 165/179
4,815,529 A 3/1989 Miyazaki et al.
5,333,597 A * 8/1994 Kirkpatrick ..... F23C 7/002 126/110 R
5,441,405 A * 8/1995 Bedford ..... F23D 14/045 126/110 C
5,649,529 A * 7/1997 Lu ..... F23M 9/06 126/110 R
6,145,501 A * 11/2000 Manohar ..... F23C 13/00 126/110 R
6,830,098 B1 12/2004 Todd et al.
6,945,320 B2 * 9/2005 Harvard, Jr. ..... F24H 3/087 126/110 R
7,195,058 B2 3/2007 Wolford et al.
8,356,658 B2 1/2013 Bunker et al.
8,683,690 B2 4/2014 Zobel et al.
10,697,668 B2 * 6/2020 Kowald ..... F24H 9/2085
2004/0069467 A1 4/2004 Thors et al.
2008/0236803 A1 10/2008 Cao et al.
2009/0071624 A1 3/2009 Zhang et al.
2009/0294112 A1 12/2009 Reifel et al.
2010/0186443 A1 * 7/2010 Zhang ..... F01K 23/10 62/515
2011/0000650 A1 1/2011 Mulder
2011/0308780 A1 12/2011 Ebner et al.
2012/0055657 A1 3/2012 Moser et al.
2012/0118536 A1 5/2012 Huang
2014/0083668 A1 * 3/2014 Deng ..... F28F 13/187 165/181
2015/0007779 A1 * 1/2015 Cui ..... F24H 1/43 122/18.3
2015/0204579 A1 7/2015 Brown et al.
2015/0204619 A1 * 7/2015 Rapicano ..... F24H 3/002 165/76
2015/0369495 A1 * 12/2015 Maricic ..... F23D 14/045 126/116 A
2016/0053997 A1 2/2016 Hasegawa et al.
2020/0309380 A1 * 10/2020 Martin ..... F24C 15/322

* cited by examiner

ENHANCED HEAT TRANSFER SURFACES FOR HEAT EXCHANGERS

CROSS REFERENCE TO RELATED APPLICATION

This application claims priority from and the benefit of U.S. Provisional Application Ser. No. 62/369,553, entitled "ENHANCED INTERNAL/EXTERNAL HEAT TRANSFER SURFACES FOR TUBULAR HEAT EXCHANGERS," filed Aug. 1, 2016, which is hereby incorporated by reference.

BACKGROUND

The present disclosure relates generally to heating, ventilating, and air conditioning systems. A wide range of applications exist for heating, ventilating, and air conditioning (HVAC) systems. For example, residential, light commercial, commercial, and industrial systems are used to control temperatures and air quality in residences and buildings. Such systems often are dedicated to either heating or cooling, although systems are common that perform both of these functions. Generally, these systems operate by implementing a thermal cycle in which fluids are heated and cooled to provide the desired temperature in a controlled space, typically the inside of a residence or building. Similar systems are used for vehicle heating and cooling, and as well as for general refrigeration.

Many HVAC systems include furnace systems. For instance, an HVAC system may include a furnace system with a burner assembly and a heat exchanger to produce hot air to heat an enclosed space, such as a room in a residential, commercial, or industrial building. Generally, furnace systems operate by burning or combusting a mixture of air and fuel in the burner assembly to produce combustion products. The combustion products may pass through tubes or piping in the heat exchanger, where air passing over the tubes or pipes extracts heat from the combustion products. The heated air may be exported from the furnace system for heating a load (e.g., a room). The heat exchanger, which in some cases may be a multi-pass heat exchanger (e.g., a two-pass or four-pass heat exchanger), may include surface features on the second pass (as well as the third and fourth passes in a four-pass heat exchanger) to enhance heat transfer.

SUMMARY

The present disclosure relates to a furnace system that includes a burner assembly that includes a burner configured to produce a flame and a heat exchanger that includes a plurality of tube passes. The plurality of tube passes cooperatively forms a conduit for flowing combustion products generated by the burner assembly. Each tube pass of the plurality of tube passes overlaps with other tube passes of the plurality of tube passes. A first tube pass of the plurality of tube passes is configured to receive the flame, and the first tube pass includes a first plurality of surface enhancements extending radially outward from an outer surface of the first tube pass relative to a central axis of the first tube pass. The furnace system also includes a baffle that is coupled to the burner assembly, extends toward the first tube pass, and is configured to contact the flame and the first tube pass.

The present disclosure also relates to a furnace heat exchanger that includes a first tube pass. The first tube pass includes an outer surface. The furnace heat exchanger also includes a second tube pass. The first tube pass and the second tube pass are fluidly coupled to one another in a U-shaped configuration. The first tube pass is configured to receive a flame and combustion products from a furnace system. Also, the first tube pass includes a surface enhancement extending radially outward from the outer surface of the first tube pass.

The present disclosure further relates to a heating, ventilating, and air conditioning (HVAC) unit that includes a furnace system and a burner assembly of the furnace system. The burner assembly includes a plurality of burners, and each burner of the plurality of burners is configured to produce combustion products and a flame. The HVAC unit also includes a heat exchanger of the furnace system. The heat exchanger includes a plurality of first tube passes. Each first tube pass of the plurality of first tube passes is configured to receive the combustion products and the flame from one burner of the plurality of burners, and each first tube pass of the plurality of first tube passes includes a surface enhancement. Additionally, the HVAC unit includes a plate of the furnace system. The plate is disposed between the plurality of burners and the heat exchanger, and the plate includes a plurality of openings. Each opening of the plurality of openings is aligned with a respective burner of the plurality of burners and a respective first tube pass of the plurality of first tube passes. Moreover, the HVAC unit includes a plurality of baffles of the furnace system. Each baffle of the plurality of baffles is disposed in a respective opening of the plurality of openings. Also, each baffle of the plurality of baffles is configured to contact the flame of a respective burner of the plurality of burners and contact a respective first tube pass of the plurality of first tube passes.

DRAWINGS

DETAILED DESCRIPTION

The present disclosure is directed to heating, ventilating, and air conditioning (HVAC) systems and components thereof. More specifically, the present disclosure relates to HVAC units with a furnace system having a multi-pass heat exchanger (e.g., 2-pass or 4-pass heat exchangers) that receives combustion products from the furnace system. In accordance with present embodiments, the first pass of the heat exchanger may include enhanced surface features (e.g., dimples, fins, protrusions) that increase the transfer of heat to air in the HVAC unit used to heat a space (e.g., a room) without impinging on the flame of the furnace system. Additionally, the furnace system may include a baffle that reduces the production of certain gases and increases heat transfer without impinging on the flame of the furnace system.

Figure 1:
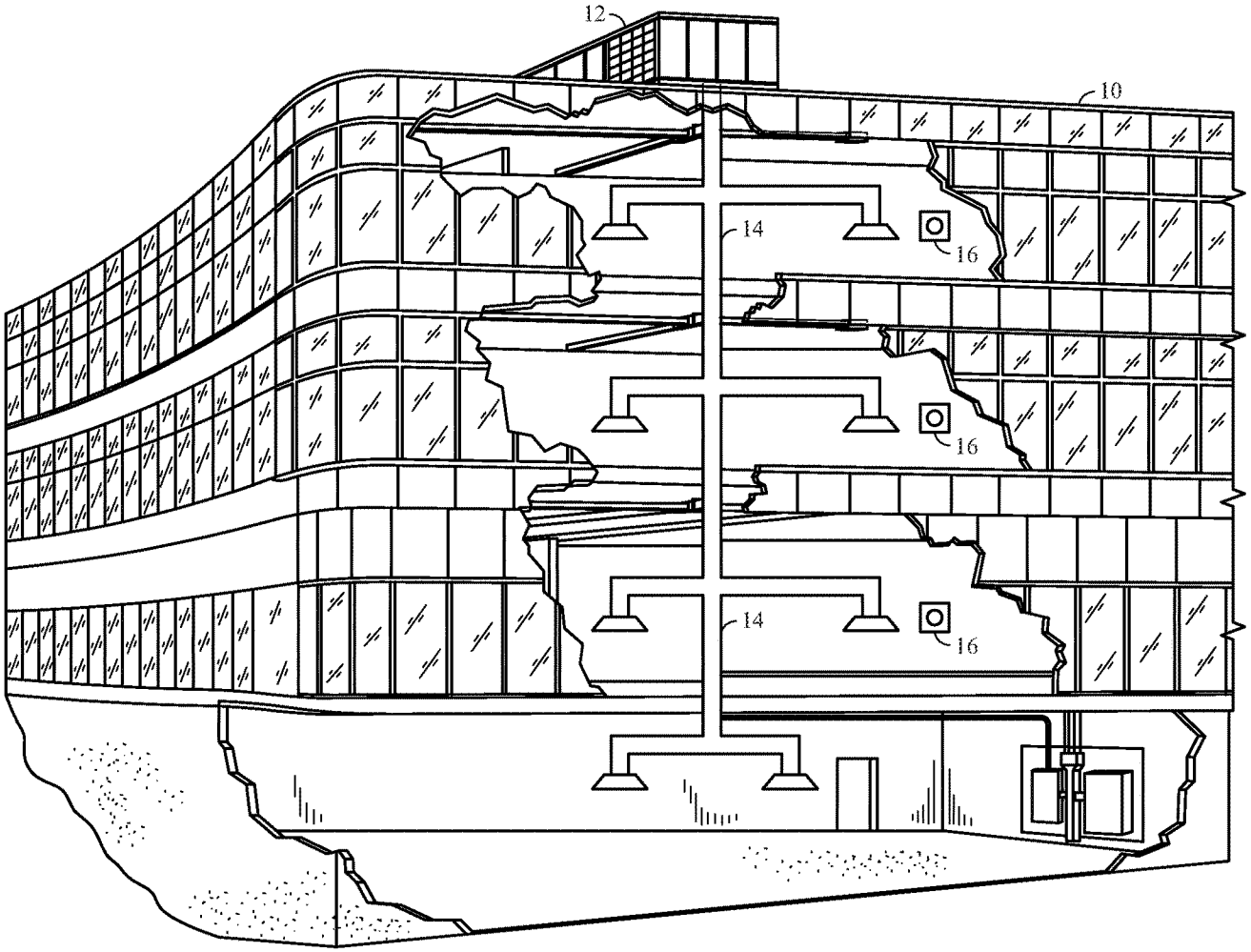
FIG. 1 is a perspective view a heating, ventilating, and air conditioning (HVAC) system for building environmental management, in accordance with embodiments described herein.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
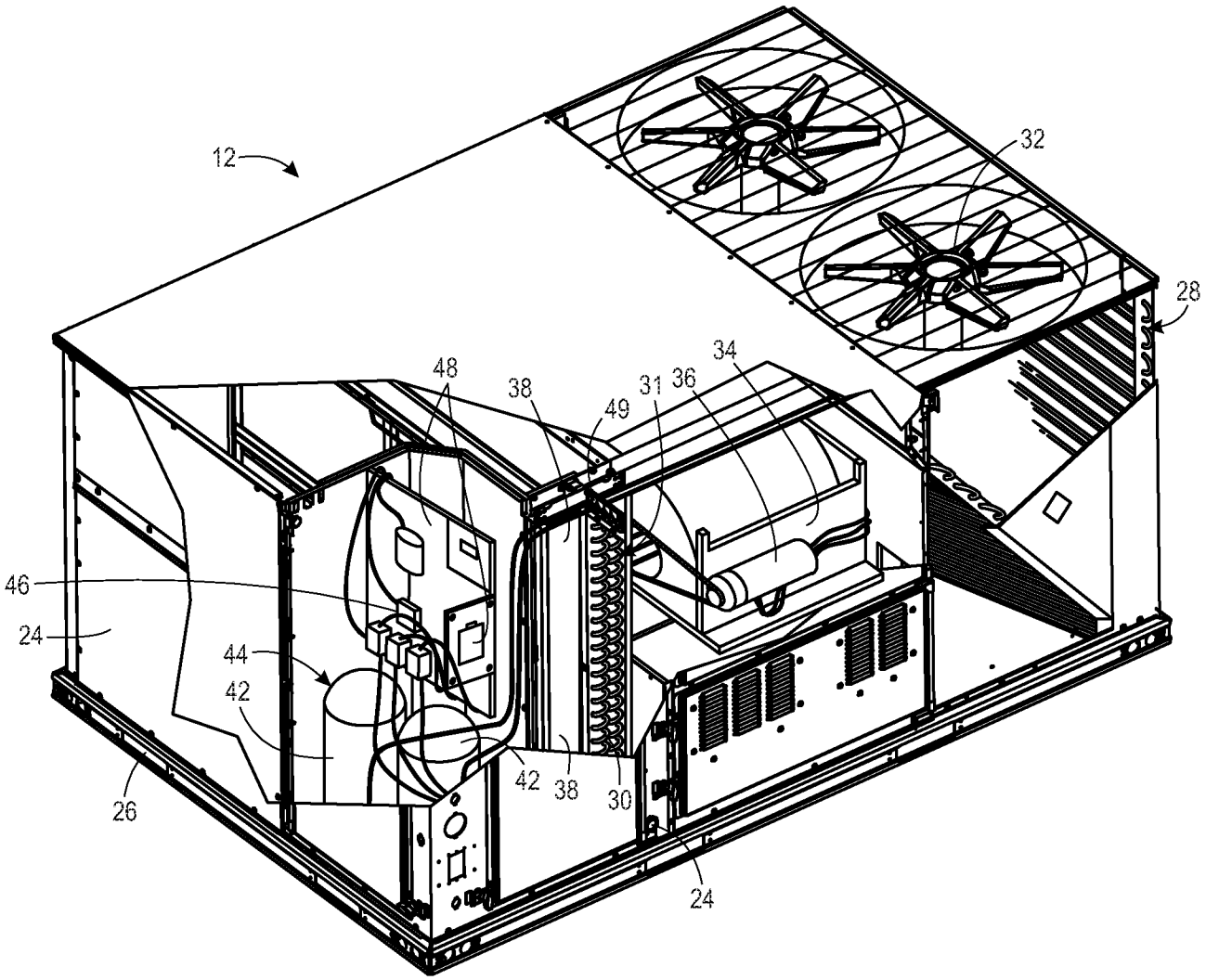
FIG. 2 is a perspective view of the HVAC unit of FIG. 1, in accordance with embodiments described herein.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant (for example, R-410A, steam, or water) through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms (one or more being referred to herein separately or collectively as the control device 16). The control circuitry may be configured to control operation of the equipment, provide alarms, and monitor safety switches. Wiring 49 may connect the control board 48 and the terminal block 46 to the equipment of the HVAC unit 12.

Figure 3:
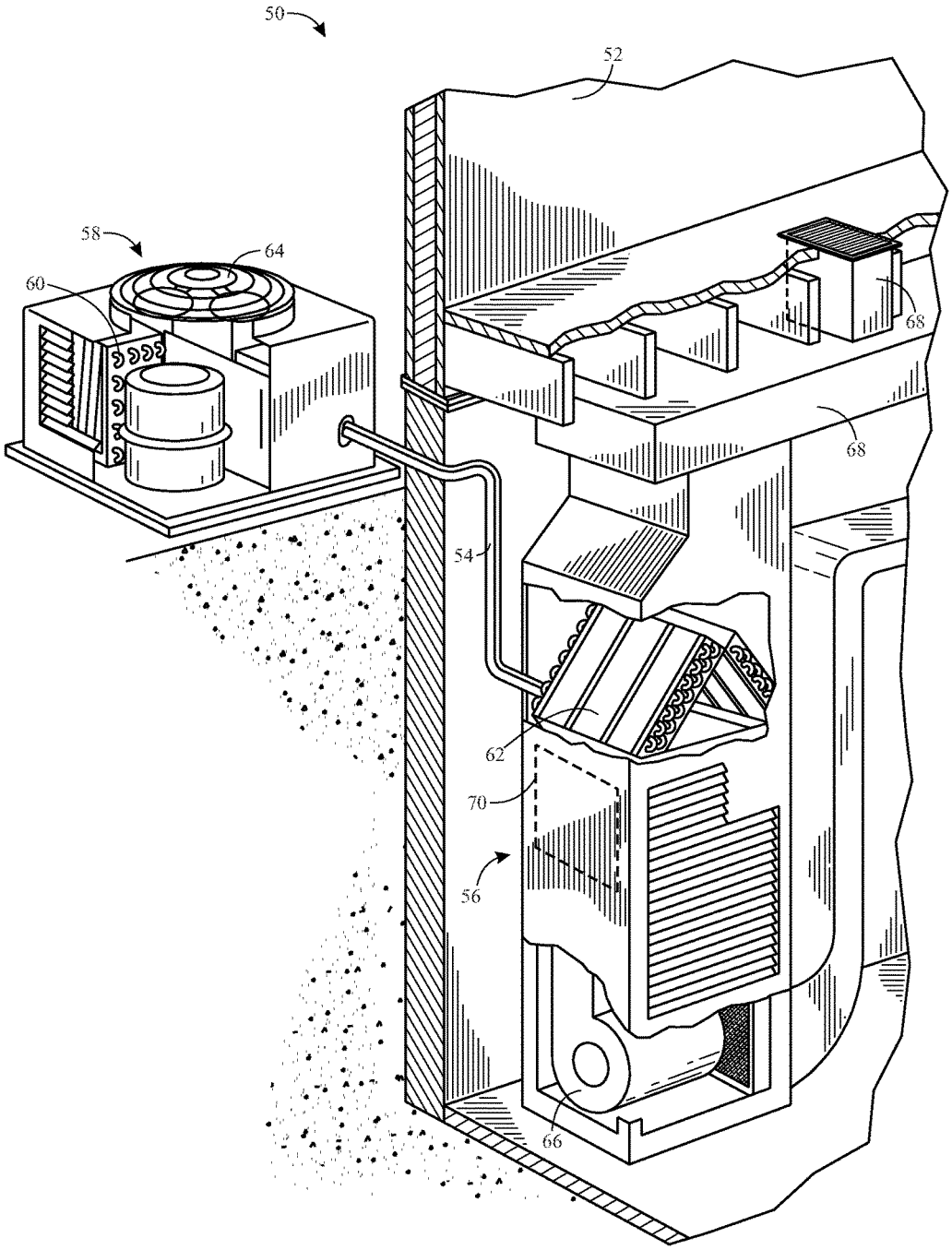
FIG. 3 is a perspective view of a residential heating and cooling system, in accordance with embodiments described herein.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant (which may be expanded by an expansion device, not shown) and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat (plus a small amount), the residential heating and cooling system 50 may become operative to refrigerate additional air for circulation through the residence 52. When the temperature reaches the set point (minus a small amount), the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger (that is, separate from heat exchanger 62), such that air directed by the blower 66 passes over the tubes or pipes and extracts heat from the combustion products. The heated air may then be routed from the furnace system 70 to the ductwork 68 for heating the residence 52.

Figure 4:
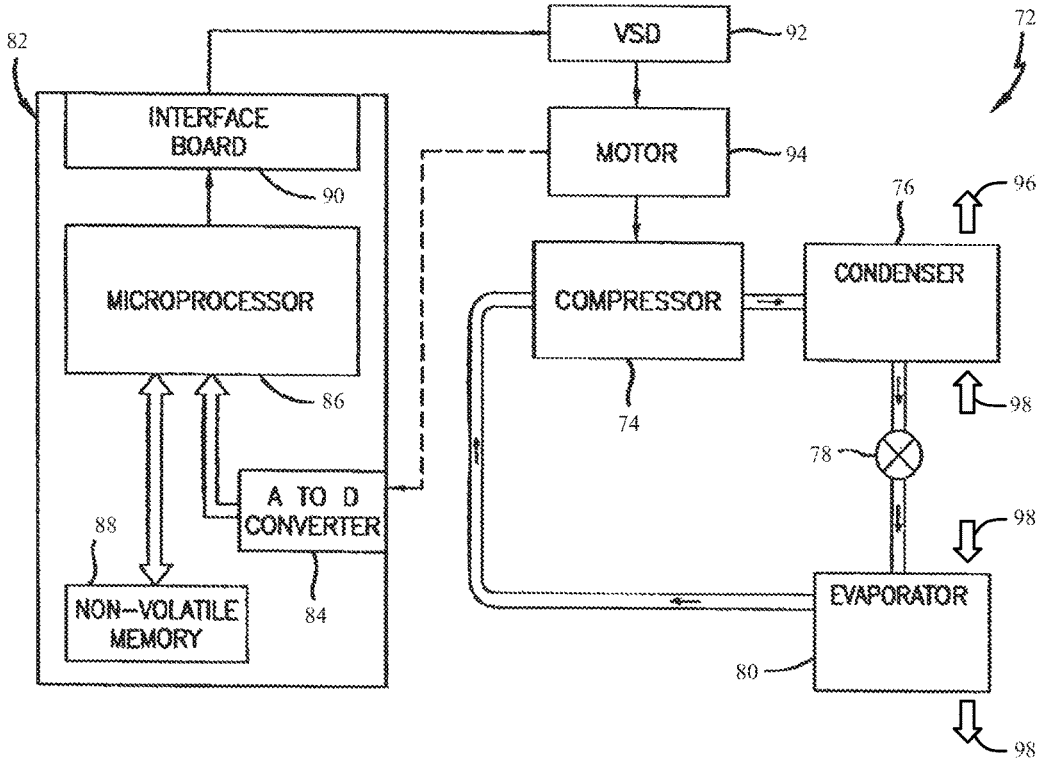
FIG. 4 is a schematic diagram of a vapor compression system that may be used in the HVAC system of FIG. 1 and the residential heating and cooling system FIG. 3, in accordance with embodiments described herein.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed below, the HVAC unit 12 may include a furnace system that includes heat exchangers with enhanced surfaces that enable greater heat transfer to air that is heated by the HVAC unit 12. Additionally, the heat exchangers discussed below may also be included in the furnace system 70 of the residential heating and cooling system 50. For instance, the heat exchangers 60 and 62 may include the features discussed below. Furthermore, the furnace or furnace system 70 may include one or more baffles that reduce the production of certain gases and increase heat transfer without impinging on flames produced by the furnace and/or furnace system 70.

Figure 5:
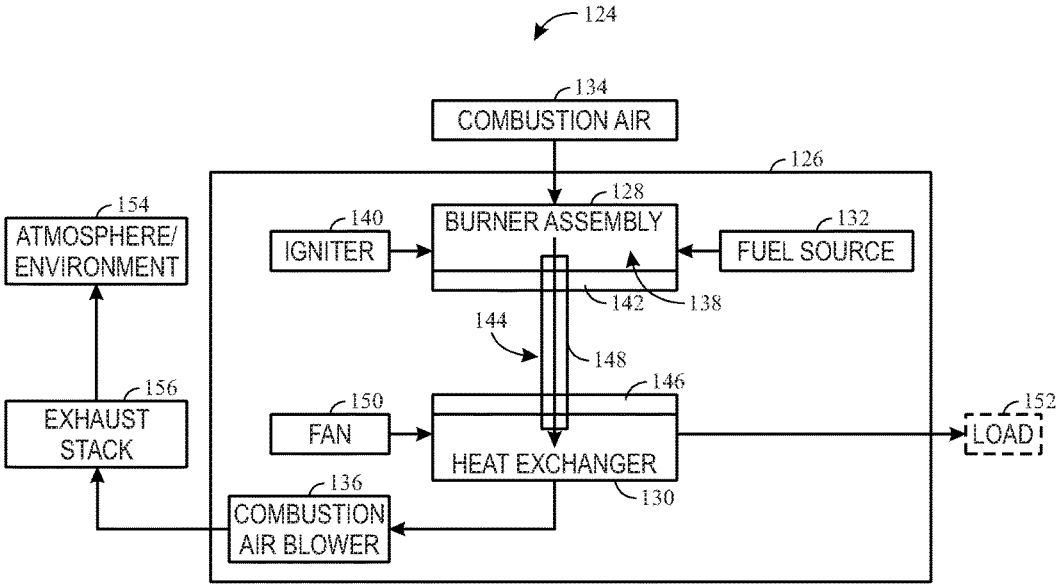
FIG. 5 is a schematic diagram of a furnace system, in accordance with embodiments described herein.

Keeping the discussion of HVAC unit 12 in mind, FIG. 5 illustrates a schematic block diagram of a furnace system 124 that may be included in the HVAC unit 12. However, it should be noted that the furnace system 124 may also be included in other HVAC systems and unit, such as those used in residential settings. The furnace system 124 includes a housing 126 having a burner assembly 128 and a heat exchanger 130, among other components, inside the housing 126. Depending on the embodiment, the burner assembly 128, the heat exchanger 130, and other components of the housing 126 may be housed in separate housings, separate portions of the housing 126, or in a single portion of the housing 126. Additionally, the various components of the furnace system 124 may be coupled to a surface of the housing 126, whether external or internal to the housing 126.

In the present embodiment, a fuel source 132 provides fuel to individual burners within the burner assembly 128. The fuel may include natural gas, liquefied petroleum gas, fuel oil, coal, wood, or the like. Air, or some other oxidant, is also provided to the burners in the burner assembly 128 from an oxidant or combustion air source 134. For example, combustion air from the combustion air source 134 may be drawn into each individual burner of the burner assembly 128 to mix with the fuel drawn into each individual burner of the burner assembly 128, as set forth above. The combustion air source 134 may be a container with compressed oxidant (e.g., compressed air), or the combustion air source 134 may be an atmosphere within or surrounding the HVAC unit 12. For example, the combustion air source 134 may be an area within the burner assembly 128 external to the individual burners of the burner assembly 128. In certain embodiments, the air may be sucked from atmosphere or some area proximate the burners into the burners of the burner assembly 128 via a pressure difference generated by a combustion air blower 136, which may also be responsible for drawing combustion products through the heat exchanger 130. In other words, a flow path exits between the burners of the burner assembly 128 and the combustion air blower 136, such that the combustion air blower 136 assists in both drawing oxidant (e.g., air) into the burners of the burner assembly 128 and drawing combustion products through the flow path between the combustion air blower 136 and the burner assembly 128. The oxidant, as previously described, mixes with the fuel in the burners to form a combustible mixture, which may be referred to herein as "the mixture." The mixture may be ignited in a primary combustion zone 138 of the burner assembly 128 via an igniter 140, where the primary combustion zone 138 refers to all the zones in each of the burners together. For example, an embodiment including four burners may include four total zones, i.e., one zone within each burner, where all four zones together are cumulatively referred to as the primary combustion zone 138.

An electrical pulse (e.g., a signal or electricity) may be sent through the igniter 140 to instruct the igniter 140 to produce a spark adjacent to or within the burners of the burner assembly 128. In some embodiments, a spark may be provided to the primary combustion zone 138 of each burner of the burner assembly 128, such that the mixture within each burner is ignited. In other embodiments, the mixture may be ignited by other means, such as a hot surface igniter or a pilot light flame.

In the illustrated embodiment, once ignited, the mixture in the primary combustion zone 138 burns and forms combustion products. The combustion products, along with a flame, exits the burners of the burner assembly 128 and passes through openings in a venturi plate 142 (e.g., shoot-through plate) of the burner assembly 128 (e.g., downstream of the burners within the burner assembly 128). Additional combustion air is provided to the flame for enhanced combustion downstream of the venturi plate 142 via a secondary combustion air gap 144.

The secondary combustion air may be pulled into the path of the flame from the secondary combustion air gap 144 via a pressure difference generated by the combustion air blower 136. Upon combustion, combustion products and/or a corresponding flame may pass through openings in the venturi plate 142. Secondary combustion air may then be provided from the secondary combustion air gap 144 (e.g., via the combustion air blower 136) for additional combustion downstream of the venturi plate 142 (e.g., secondary combustion in a secondary combustion zone downstream of the venturi plate 142). Combustion air provided from the secondary combustion air gap 144 may enhance combustion of the mixture in the burner assembly 128, outside of the burner assembly 128, or a combination thereof, and may reduce the overall noise of the combustion process. It should be noted that a space may exist between the outlets of the individual burners of the burner assembly 128 and the openings in the venturi plate 142 of the burner assembly 128, and that secondary combustion may take place within this space even before the flame and/or combustion products pass through the venturi plate 142. In other words, secondary combustion may take place upstream of the venturi plate 142 (e.g., between the venturi plate 142 and the outlets of the burners of the burner assembly 128), downstream the venturi plate 142 (e.g., after receiving additional secondary combustion air from the secondary combustion air gap 144), or a combination thereof. The inclusion of the secondary combustion air gap 144 enables secondary combustion to occur at some point downstream of the venturi plate 142, such that combustion is enhanced and such that velocity of the flow through the venturi plate 142 is reduced, as set forth above, which reduces noise.

The openings of the venturi plate 142 are generally aligned with openings of tubes of the heat exchanger 130. In some embodiments, the openings in the venturi plate 142 are also aligned with openings in a panel 146 (e.g., vestibule panel) coupled to the tubes of the heat exchanger 130, where the panel 146 is positioned between the venturi plate 142 and the tubes. Although the boundaries along the openings in the venturi plate 142 may not be directly coupled with or otherwise engaging the tubes, the openings may be generally aligned to facilitate flow of combustion products therethrough. In some embodiments, the secondary combustion air gap 144 may partially separate the venturi plate 142 from the tubes or from a component that includes the tubes (e.g., the panel 146), as will be discussed in detail below. However, during operation, the combustion products still generally pass through the openings in the venturi plate 142 and extend into and through the tubes of the heat exchanger 130 via entry into the openings of the panel 146. In some embodiments, secondary combustion may occur in the area between the venturi plate 142 and the panel 146 and may be enhanced via added combustion air from the secondary combustion air gap 144. However, in other embodiments, secondary combustion may not occur in this area, and this area may only be included to draw secondary combustion air into the path of the combustion products exiting the venturi plate 142, such that secondary combustion may occur just inside the tubes of the heat exchanger 130 (e.g., after passing through the openings in the panel 146).

The furnace system 124 may also include one or more baffles 148. More specifically, the baffles 148 may be colocated with the flames produced by burners of the burner assembly 128, extend through the secondary combustion air gap 144, and contact the heat exchanger 130. In some embodiments, the baffles 148 may extend into the heat exchanger 130. The baffles 148 may quench the flame and reduce levels of nitrous oxide produced from combusting the mixture. However, it should be noted that the flames produced by the burners may travel along and/or through the baffles 148 and enter the heat exchanger 130. Moreover, as a result of being placed in the flames, the baffles 148 may generate infrared and/or radiant heat, which may be transferred to the heat exchanger 130. Additionally, the baffles 148 may be made from iron-chromium-aluminum alloys, nickel-chromium alloys, iron-chromium-cobalt-nickel alloys, nickel-copper alloys, nickel-cobalt alloys and other alloys configured to withstand high temperatures (e.g., temperatures greater than 1,000° C.) and/or promote heat transfer.

A fan 150, such as an air blower or some other flow-motivating device, forces a medium (e.g., air) over the tubes in the heat exchanger 130 to generate a heated medium by transferring heat from the combustion products to the medium. In some embodiments, the fan 150 may be the same as the fan 32 of FIG. 2. The fan 150 operates to blow air over the tubes to generate hot air, and the hot air may be exported to a load 152 (e.g., a room) for heating the load 152. It should be noted that the fan 150, in some embodiments, may be a separate component from the heat exchanger 130 and may blow air across the heat exchanger 130 to generate the hot air. In another embodiment, the fan 150 may be located inside the heat exchanger 130 (e.g., as a combined component) and may operate to blow the air directly over the tubes of the heat exchanger 130, as previously described. Further, it should be noted that the fan 150 may reside in any appropriate portion of the heat exchanger 130. For example, the fan 150 may be at a bottom of the heat exchanger 130 and blow air upwards over the tubes, the fan 150 may be at the left or right of the heat exchanger 130 and blow air cross-wise over the tubes, or the fan 150 may be at the top of the heat exchanger 130 and blow air downwards over the tubes. Further still, the fan 150 may be a mechanical fan, a centrifugal fan, or some other type of fan.

Heat may be transferred more efficiently to the medium (e.g., air) that passes over the tubes of the heat exchanger 130 when the heat exchanger includes surface enhanced surfaces. For example, and as discussed below in greater detail, the tubes of the heat exchanger 130 may include various surface enhancements, such as protrusions that may extend outwards from or into the heat exchanger 130. It is to be appreciated that, in presently disclosed embodiments, the first pass of a multi-pass heat exchanger may include such surface enhancements and not impinge on any flames produced by the burner assembly 128. Moreover, the first pass of a multi-pass heat exchanger may also contact and/or include a portion of the baffle 148.

Combustion products passing through the tubes of the heat exchanger 130 may be motivated through the tubes via the combustion air blower 136. Indeed, the combustion air blower 136 may generate a pressure difference between an area surrounding the burner assembly 128 and a flow path from the burner assembly 128 to an external environment 154. In other words, the combustion air blower 136 may draw air into the burners of the burner assembly 128, draw the combustion products from the burners of the burner assembly 128 into the tubes of the heat exchanger 130, and draw the combustion products through the tubes of the heat exchanger 130. Additionally, the combustion air blower 136 may be configured to pull the combustion products from the heat exchanger 130 and blow the combustion products into an exhaust stack 156 of the furnace system 124, which may be configured to export the combustion products from the furnace system 124 into the environment 154 or some other area external to the furnace system 124. Further still, the combustion air blower 136 may be responsible for drawing secondary combustion air from the secondary combustion air gap 144 into the path of the flame and combustion products as they travel through the venturi plate 142 and through the panel 146 into the heat exchanger 130.

Figure 6:
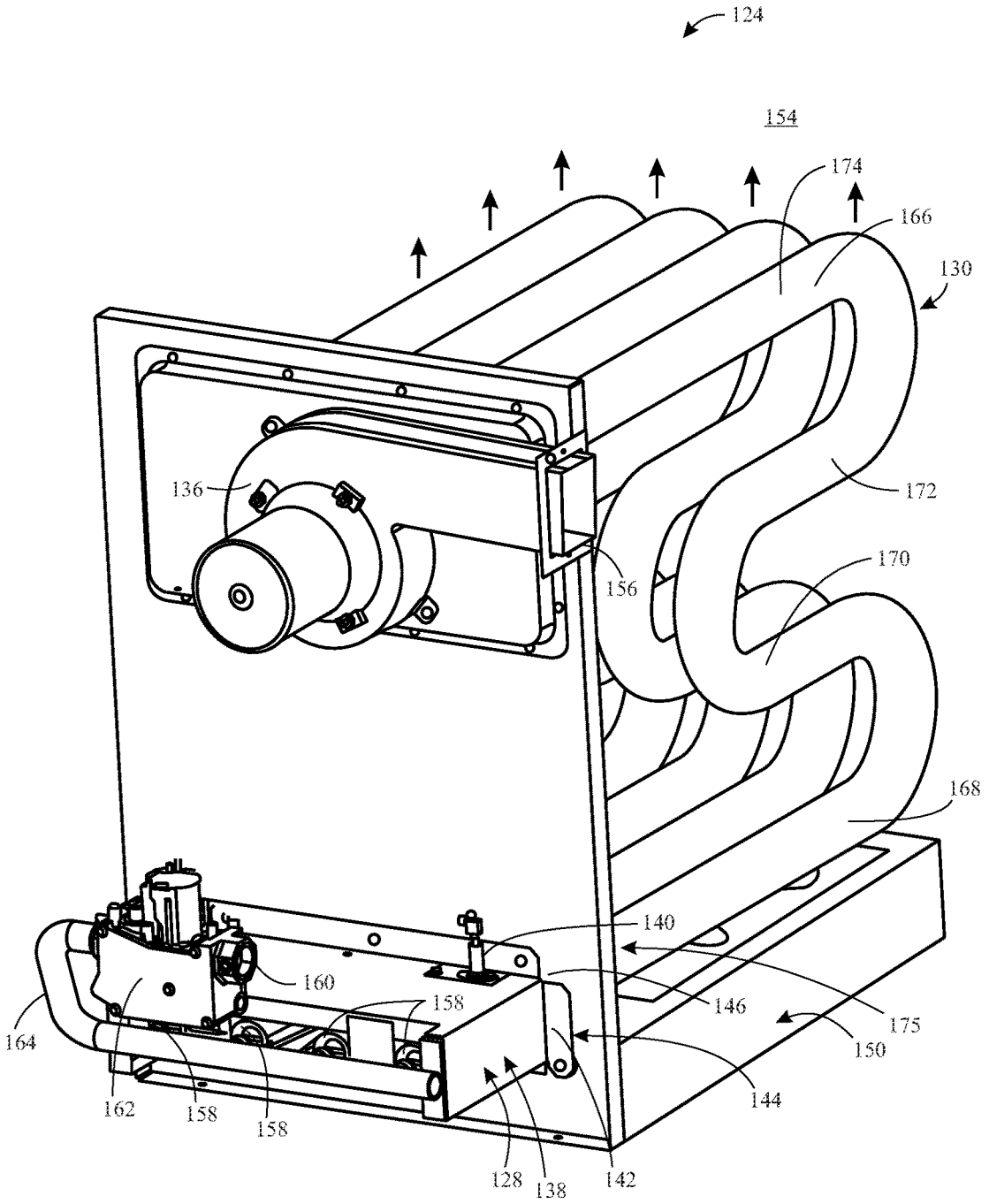
FIG. 6 is a perspective view of a furnace system, in accordance with embodiments described herein.

With the discussion of FIG. 5 in mind, FIG. 6 is perspective view of an embodiment of the furnace system 124. In the illustrated embodiment, the burner assembly 128 is located near a bottom surface 38 of the furnace system 124. Four burners 158 are located within the burner assembly 128. However, in other embodiments the furnace system 124 may include more or less than four burners 158 (e.g., one, two, three, five, six, or more burners 158). As previously described, each burner 158 is configured to combust a mixture of air and fuel. Additionally, in the illustrated embodiment, fuel is routed from a fuel source through a gas inlet 160 of a control valve 162. The control valve 162 is coupled to a manifold 164, which distributes the fuel to each burner 158. In some embodiments, the fuel may be distributed via the manifold 164 to each burner 158 evenly. The control valve 162 may control a flow of fuel to the burners 158, such that the control valve 162 controls a quantity (e.g., volume) of fuel in the mixture of each burner 158.

The igniter 140 provides a spark to the burners 158 for igniting the mixture in each burner 158. The combustion/burning occurring within each burner 158 may be considered to be occurring in the primary combustion zone 138. As previously described, the mixture includes air drawn into an interior of each burner 158 and fuel provided to each burner 158 via the manifold 164. However, additional oxidant (e.g., air) may be introduced via the secondary combustion air gap 144 for enhancing combustion/burning. The secondary combustion air gap 144 is located downstream of the burners 158. In the illustrated embodiment, the secondary combustion air gap 144 is located between the burner assembly 128 and the heat exchanger 130. Specifically, the secondary combustion air gap 144 is located downstream of the venturi plate 142 of the burner assembly 128 and upstream of the vestibule panel 146 of the heat exchanger 130, which may serve as an entire front panel of the furnace system 124.

In the illustrated embodiment, combustion products, including the flames of the burners 158, may pass through tubes 166 of the heat exchanger 130. More specifically, the combustion products and/or the flame are routed through the openings in the venturi plate 142 of the burner assembly 128, through the vestibule panel 146, and into tubes 166 of the heat exchanger 130, where the secondary combustion air gap 144 provides additional secondary combustion air to the flame and/or combustion products downstream of the venturi plate 142. The fan 150 in the illustrated embodiment is located near the bottom surface of the housing 126 of the furnace system 124. The fan 150 is configured to blow air over and/or across the tubes 166 of the heat exchanger 130, such that the air extracts heat from the combustion products routed through the heat exchanger 130. The hot air is may be routed through a duct that delivers the hot air to a load (e.g., the load 152), such as a room of a building. The combustion products may be pulled through, and blown from, the tubes 166 of the heat exchanger 130 into an exhaust stack 156 (e.g., a chimney), where the combustion products may be exported from the furnace system 124 to the environment 154.

The heat exchanger 130 may be a multi-pass heat exchanger. For instance, as illustrated, the heat-exchanger is a four-pass heat exchanger. In other words, the tubes 166 of the heat exchanger 130 have a first tube pass 168, a second tube pass 170, a third tube pass 172, and a fourth tube pass 174 that overlap with at least one of the other tube passes 168, 170, 172, 174 and cooperatively form a conduit. For instance, the tube passes 168, 170, 172, 174 may be fluidly coupled to at least one other of the tube passes 168, 170, 172, 174 in a U-shaped configuration (e.g., a U-shaped bend). Combustion products, including flames produced by the burners 158, may enter the heat exchanger 130 via openings 175 in the first tube pass 168 of the tubes 166, and the combustion products may continue to travel through the second tube pass 170, third tube pass 172, and fourth pass 174 of the heat exchanger 130. More specifically, the combustion products, including the flame, may travel through the venturi plate 142 and the vestibule panel 146 along and/or through a baffle (e.g., baffle 148) before entering the first tube pass 168 of the heat exchanger 130. Additionally, a combustion air blower 136 may be coupled to the fourth tube pass 174 of the heat exchanger to draw air and the combustion products through the heat exchanger 130. The contents of the heat exchanger 130 may exit the heat exchanger 130 and the furnace system 124 via an exhaust stack (e.g., exhaust stack 156).

While the illustrated embodiment of the heat exchanger 130 is a four-pass heat exchanger, it should be noted that, in other embodiments, different heat exchangers may be used. For example, a two-pass heat exchanger, which may include a first pass and a second pass, may be used instead of a four-pass heat exchanger. For instance, a two-pass heat exchanger may generally have the shape of a "U," with the first pass receiving the combustion products, including the flame(s), from the burner assembly 128. Moreover, the heat exchanger 130 may be made from various materials. For example, the heat exchanger 130 may be made from aluminized steel, such as steel that has an aluminum coating or an aluminum-silicon alloy coating. Additionally, in some embodiments, the heat exchanger 130 may be made from aluminum or copper.

In any case, the first tube pass 168, as well as the other passes (i.e., the second tube pass 170, third pass 172, and fourth tube pass 174) may include surface enhancements. The surface enhancements may improve the transfer of heat from the heat exchanger 130 to the air surrounding the heat exchanger 130 that is to be delivered to a load (e.g., a room to be heated). As discussed below with regard to FIGS. 8-17, the surface enhancements may include features that increase the surface area of the tubes 166 of the heat exchanger 130. For example, the surface enhancements may include features that extend outwards from and/or into the tubes 166 of the heat exchanger. In any case, the surface enhancements of the first tube pass 168 are configured such that the heat exchanger 130 will not impinge on the flame(s) produced by the burner assembly 128.

Figure 7:
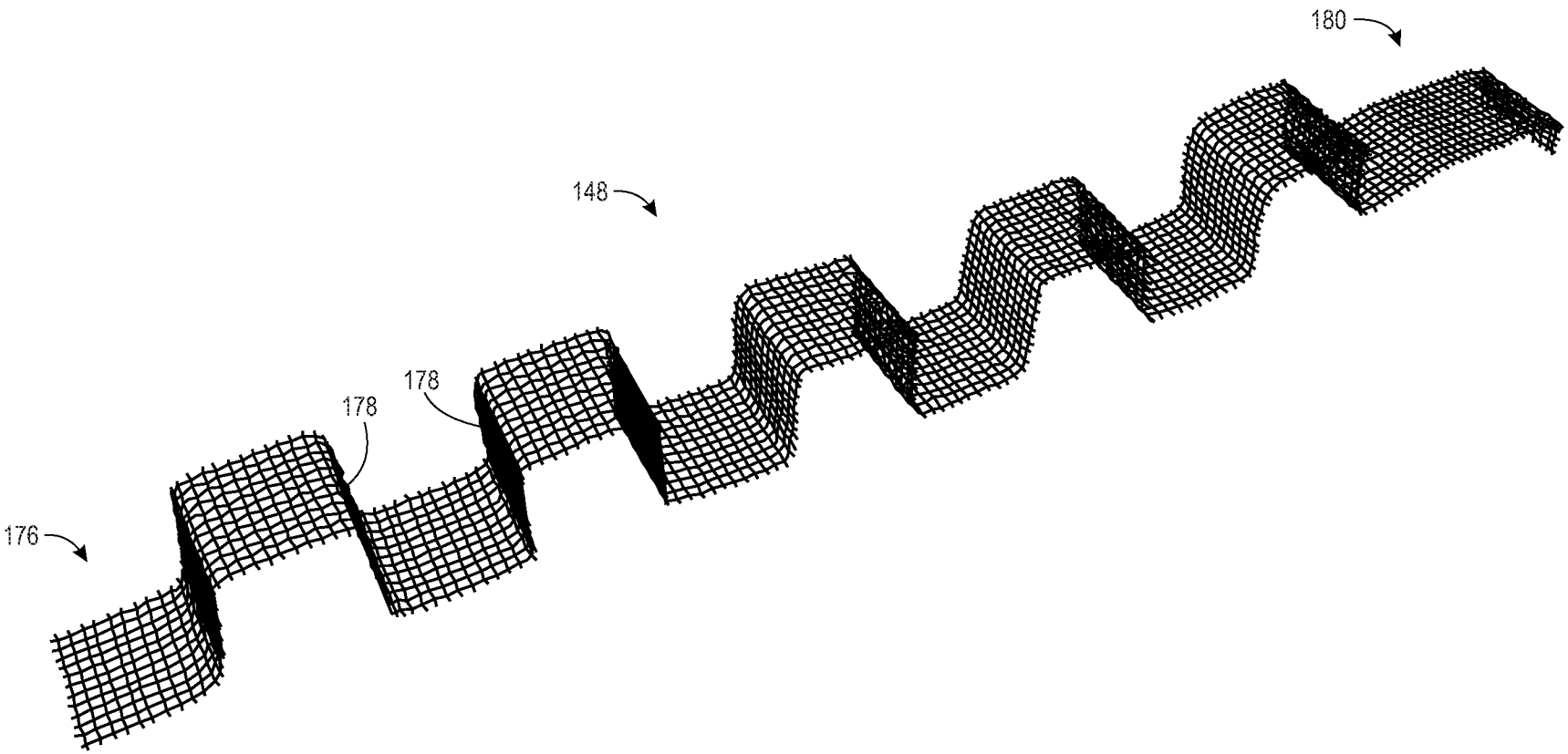
FIG. 7 is a perspective view of a baffle that may be included in the furnace system of FIG. 6, in accordance with embodiments described herein.

Continuing with the drawings, FIG. 7 is a perspective view of one embodiment of the baffle 148. As described above, the baffle 148 may be placed in a common location where a flame is produced by the burner 158. More specifically, a front portion 176 of the baffle 148 may be placed in a flame produced by one of the burners 158. The baffle 148 includes a mesh structure to enable the flame (and other combustion products) to travel through faces 178 of the baffle 148 and enter the heat exchanger 130. The heat exchanger 130 may contact and/or be coupled to the baffle 148 via an end portion 180 of the baffle 148. More specifically, the end portion 180 of the baffle 148 may contact and/or be coupled to the opening 175 of the heat exchanger 130 through which the heat exchanger 130 receives the combustion products, including the flame(s). In some embodiments, some or all of the end portion 180 may be disposed within the heat exchanger 130 (e.g., within one of the tubes 166 of the heat exchanger 130). For example, in the embodiment illustrated in FIG. 6, the end portion 180 of the baffle 148 may contact and/or be partially disposed within the first tube pass 168 of the heat exchanger 130.

Inclusion of the baffle 148 in the furnace system 124 may increase the efficiency of the furnace system 124. For instance, as discussed above, the baffle 148 may allow for increased heat transfer to the heat exchanger 130, which may allow for air that is to be sent to a load (e.g., a room supplied with air by the furnace system 124) to be more efficiently heated. Heat may be transferred even more efficiently in embodiments where the furnace system 124 includes the baffle 148 as well as a multi-pass heat exchanger (e.g., heat exchanger 130) that includes surface enhancements on the first tube pass 168. Indeed, in such embodiments the heat exchanger 130 may be a more compact size yet still enable efficiencies observed in furnace systems that do not include both the baffle 148 as well as a multi-pass heat exchanger with surface enhancements on the first tube pass 168. Additionally, while the illustrated embodiments of the baffle 148 has a repeating "U" shape, in other embodiments, the baffle 148 may be a different shape. For example, in another embodiment, the baffle 148 may have a repeating "V" shape.

FIGS. 8-17 show various views of different embodiments of portions of the heat exchanger 130. More specifically, FIGS. 8-17 show different surface enhancements that may be present on any of the passes of the heat exchanger 130, including the first tube pass 168. Moreover, each of the embodiments associated with FIGS. 8-17 may be used on the first tube pass 168 of the heat exchanger 130 without causing impingement of the flame(s) produced by the burner (s) 158. In each of the illustrated embodiments, some or all of the surface enhancements extend radially outward from an exterior surface of the heat exchanger 130, which enables the flame(s) from the burner assembly 128 to enter the first tube pass 168 of the heat exchanger 130 without being impinged. For example, in some embodiments, the surface enhancements increase an interior volume of the first tube pass 168, which may reduce and/or eliminate a likelihood of flame impingement occurring. Furthermore, when combined in a furnace system (e.g., furnace system 124) that includes one or more baffles 148, the flame(s) will not be impinged by a heat exchanger 130 that includes the surface enhancements illustrated in FIGS. 8-17. That is, even though the baffle(s) 148 may quench the flame(s) produced by the burner assembly 128, the flame(s) can enter the heat exchanger 130 without being impinged. Generally speaking, and as discussed below, the surface enhancements of the heat exchanger 130 may include various features that may extend away from and/or into the heat exchanger 130. Moreover, the surface enhancements may increase the transfer of heat from the heat exchanger 130 to the medium (e.g., air) passing over the heat exchanger 130. Increased heat transfer may increase the efficiency of the furnace system 124 and/or an HVAC unit (e.g., HVAC unit 12) in which the furnace system 124 may be disposed.

Figure 8:
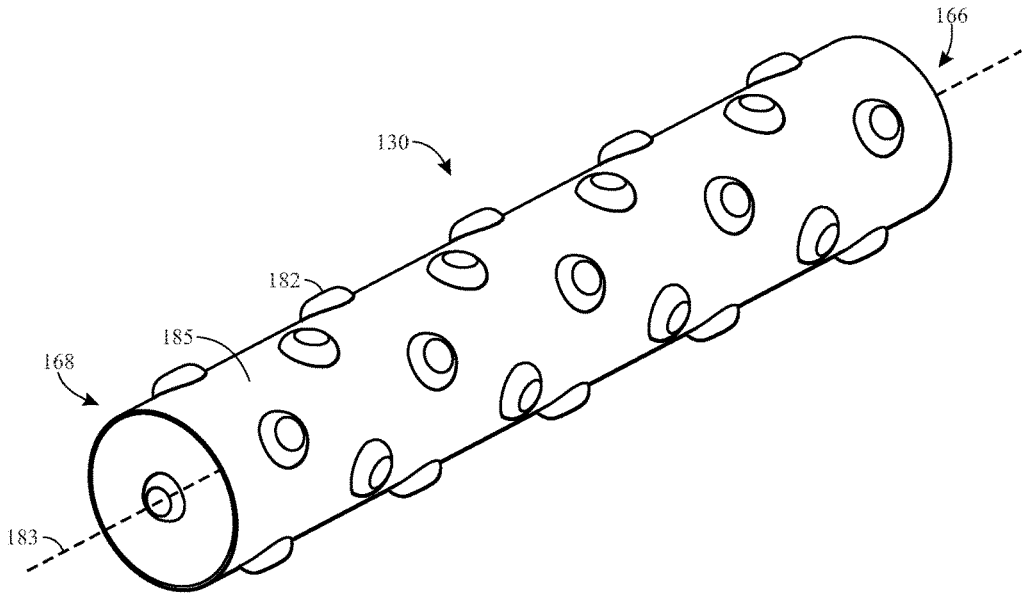
FIG. 8 is a perspective view of a portion of a heat exchanger, in accordance with embodiments described herein.
Figure 9:
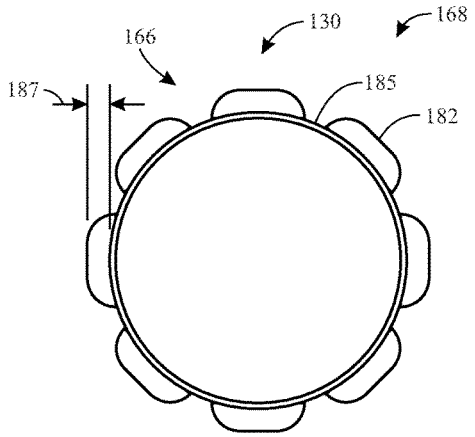
FIG. 9 is an axial view of the portion of the heat exchanger of FIG. 8, in accordance with embodiments described herein.

FIG. 8 is a perspective view of the first tube pass 168 of the tube 166 of the heat exchanger 130, illustrating surface enhancements in the form of dimples 182 formed in the first tube pass 168. Specifically, the dimples 182 extend radially outwards, relative to a central axis 183 (i.e., longitudinal axis) of the tube 166, from an outer surface 185 of the tube 166. FIG. 9 is an axial view of the first tube pass 168 of the tube 166 shown in FIG. 8. As shown, the dimples 182 extend a distance 187 from the outer surface 185 of the tube 166. In certain embodiments, the distance 187 may measure one inch or less, though in other embodiments, the dimples 182 may be larger (i.e., extend a greater distance, such as three or four inches).

Figure 10:
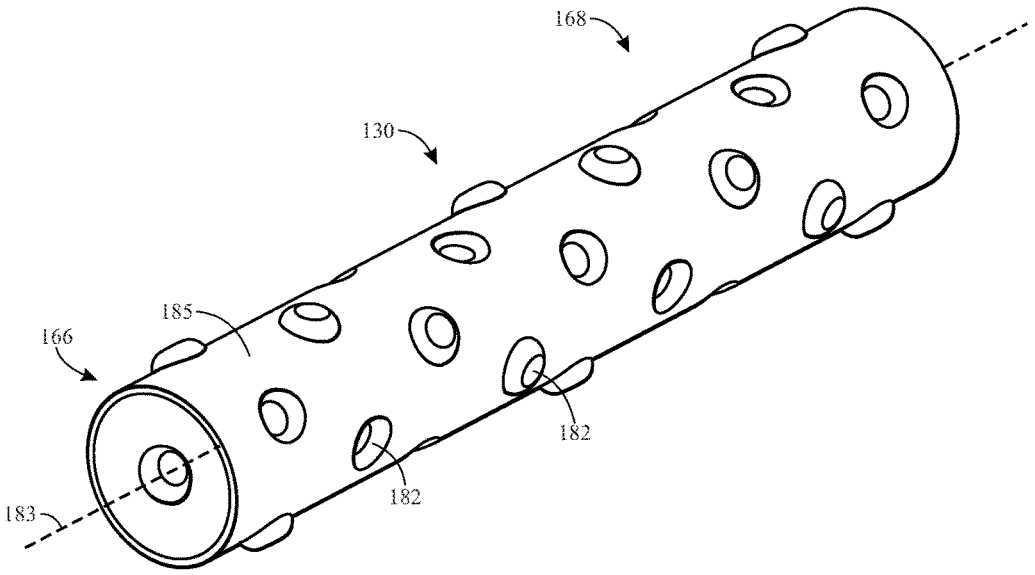
FIG. 10 is a perspective view of a portion of a heat exchanger, in accordance with embodiments described herein.
Figure 11:
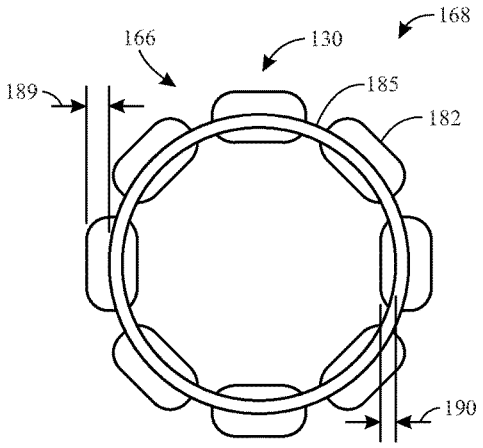
FIG. 11 is an axial view of the portion of the heat exchanger of FIG. 10, in accordance with embodiments described herein.

Additionally, as shown in FIG. 10, the first tube pass 168 of the tube 166 of the heat exchanger 130 may include some dimples 182 that extend radially outwards from an outer surface 185 of the first tube pass 168 of the heat exchanger 130 relative to the central axis 183 and some dimples 182 that extend radially inward relative to the central axis 183. Additionally, it should be noted that, in some embodiments, the dimples 182 may only extend radially into the heat exchanger 130. FIG. 11 is an axial view of the first tube pass 168 of the tube 166 shown in FIG. 10. As illustrated, the dimples 182 extend outward a distance 189 or extend inward a distance 190 from the outer surface 185 of the tube 166. The distances 189, 190 may be similar or the same as the distance 187. However, it should be noted that in some embodiments, the distance 190 may be less than the distance 190 to reduce the likelihood of impingement of the flame(s).

Regarding the embodiments illustrated in FIGS. 8-11, the dimples 182 may cover various amounts of the outer surface 185 of the tube 166. For example, the dimples 182 may cover five to seventy-five percent of the outer surface 185 of the tube in various embodiments.

Figure 12:
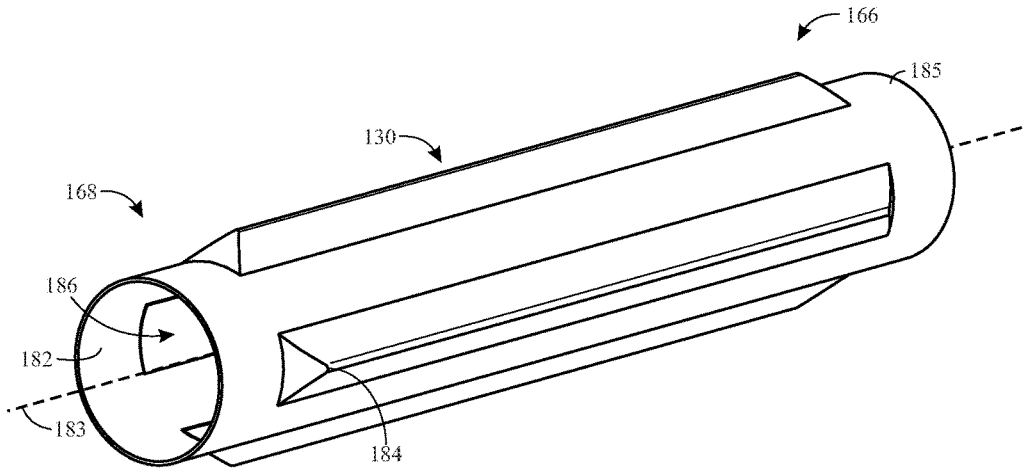
FIG. 12 is a perspective view of a portion of a heat exchanger, in accordance with embodiments described herein.
Figure 13:
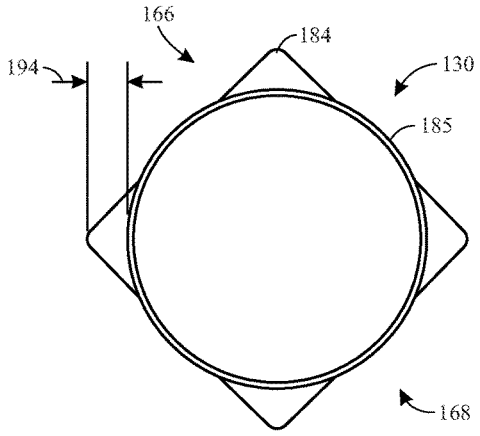
FIG. 13 is an axial view of the portion of the heat exchanger of FIG. 12, in accordance with embodiments described herein.

Continuing with the illustrated embodiments of the heat exchanger 130, FIG. 12 is perspective view of an embodiment of a portion of the first tube pass 168 of the tube 166 of the heat exchanger 130 that includes another type of surface enhancement, i.e., protrusions 184 (e.g., longitudinal fins). The protrusions 184 extend longitudinally along the heat exchanger 130 relative to the central axis 183. However, in other embodiments, the protrusions 184 may extend circumferentially around the heat exchanger 130. As illustrated, the protrusions may be formed on the heat exchanger 66 in such a manner than increases the volume within the heat exchanger 130. In other words, a space 186 may be formed by the protrusions 184 on an interior surface 192 of the heat exchanger 130. Additionally, while the present embodiment includes four protrusions 184, it should be noted that other embodiments may include a different number of protrusions 184 (e.g., one, two, three, five, six, seven or more protrusions 184). FIG. 13 is an axial view of the embodiment of the first tube pass 168 of the tube 166 shown in FIG. 12. As illustrated, the protrusions 184 may extend a distance 194 from the outer surface 185 of the tube 166. The distance 194 may be greater than the distances 187, 189, 190 of the dimples 182 discussed above. For example, the distance 194 may be greater than four inches. However, in other embodiments, the distance 194 may be similar to any of the distances 187, 189, 190 of the dimples 182.

Figure 14:
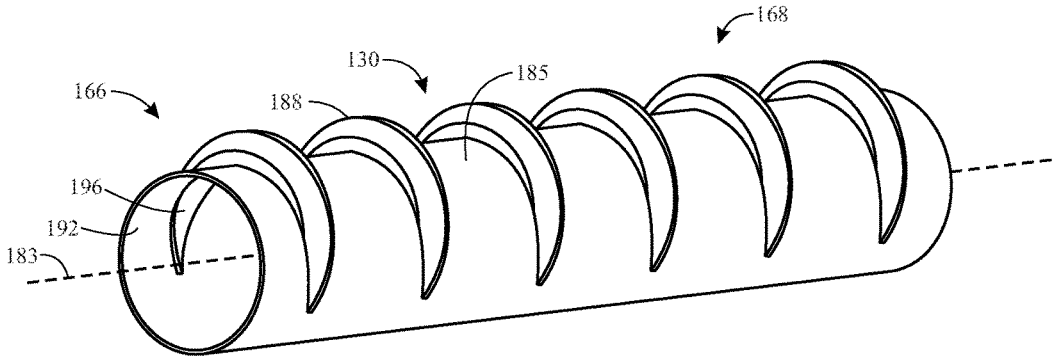
FIG. 14 is a perspective view of a portion of a heat exchanger, in accordance with embodiments described herein.
Figure 15:
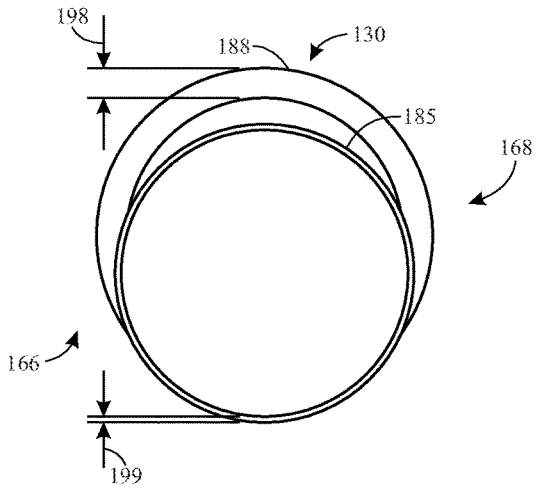
FIG. 15 is an axial view of the portion of the heat exchanger of FIG. 14, in accordance with embodiments described herein.

FIG. 14 is a perspective view of a portion of another embodiment of the first tube pass 168 of the tube 166 of the heat exchanger 130 that includes fins 188 that extend circumferentially around the heat exchanger 130 relative to the central axis 183 (i.e., longitudinal axis). More specifically, the fins 188 are segmented partial fins. In other words, the fins 188 extend only partially about the circumference of the first tube pass 168. However, in other embodiments, the fins 188 may be fully or partially circular. In any case, the fins 188 may be formed as part of the heat exchanger 130. For instance, the fins 188 may be formed by making protrusions 196 (e.g., via a mandrel) on the interior surface 192 of the tube 166. FIG. 15 is an axial view of the embodiment of the first tube pass 168 of the tube 166 shown in FIG. 14. The fins 188 may extend a distance 198 radially outward from the exterior surface 185 of the tube 166. The distance 198 may vary at various portions of the tube 166. Moreover, the distance 198 may be similar to the distances 187, 189, 190, 194 described above. It should be noted that the distance 198 may also vary based on a thickness 199 of the tube 166. For instance, for a greater thickness 199, a greater distance 198 may be possible.

Figure 16:
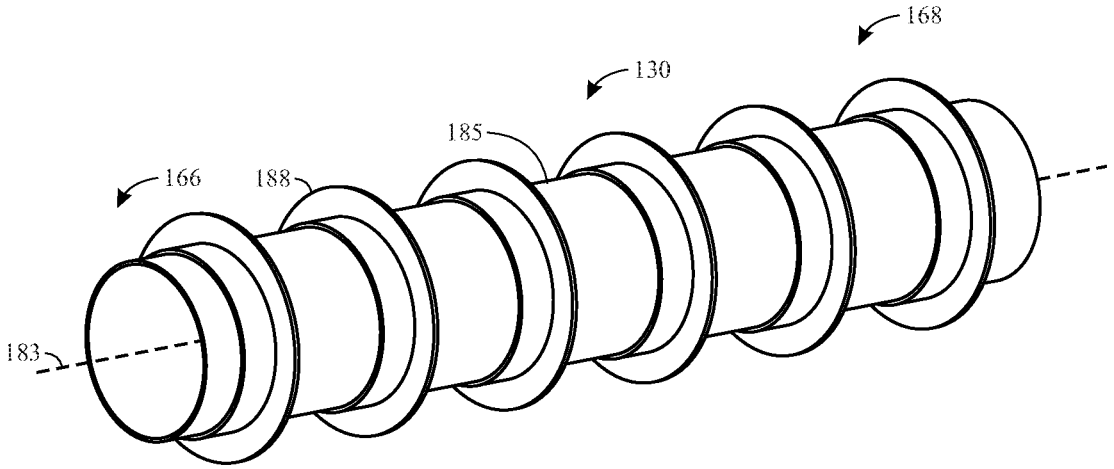
FIG. 16 is a perspective view of a portion of a heat exchanger, in accordance with embodiments described herein.
Figure 17:
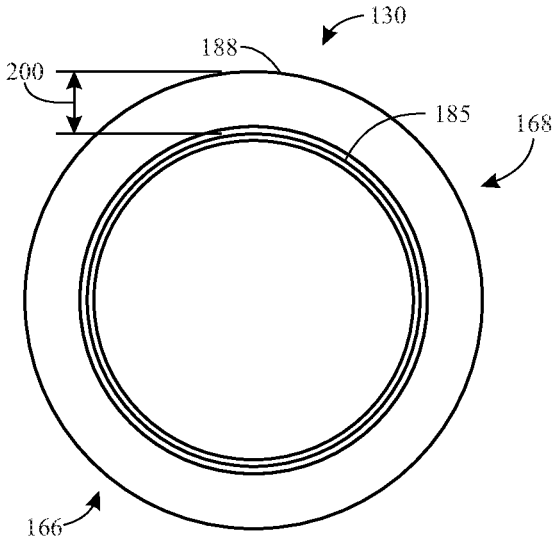
FIG. 17 is an axial view of the portion of the heat exchanger of FIG. 16, in accordance with embodiments described herein.

However, in other embodiments, the fins 188 may be attached to the outer surface 185 of the first tube pass 168 of the tube 166 of the heat exchanger 130. For example, as illustrated in FIG. 16, the fins 188 are coupled to the heat exchanger 130 via a mechanical securement. The mechanical securement may include a mechanical connection (e.g., screws, rivets, or clamps such as toggle-locking clamps) or expanding the tubing 66 of the heat exchanger 130 in such a manner as to promote heat transfer. Additionally, the fins 188 may be made from materials such as aluminum, copper, and steel. The fins 188 are arranged circumferentially around the outer surface 185 of the tube 166 relative to a central axis 183. The fins 188 extend radially outward from the first tube pass 168 of the tube 166 relative to the central axis 183 (i.e., longitudinal axis). FIG. 17 is an axial view of the embodiment of the first tube pass 168 of the tube 166 shown in FIG. 16. As illustrated, the fins 188 may extend radially a distance 200 from the outer surface 185 of the tube 166. The distance 200 may be similar to the distances 187, 189, 190, 194, 198 described above. It should also be noted that the distance 200 may differ between two different fins 188. For example, one fin 188 may extend a distance 200 that is different from another fin 188 that is positioned on first tube pass 168 of the tube 166.

In any case, it should be noted that the surface enhancements of the heat exchanger 130 illustrated in the embodiments of FIGS. 8-17 may be distributed evenly (e.g., in a staggered arrangement), unevenly, in a pattern, without a pattern, circumferentially, longitudinally, or any combination thereof. Additionally, the heat exchanger 130 may include a higher or lower density of the surface enhancements in other embodiments. That is, in other embodiments, the heat exchanger 130 may include a number of surface enhancements that is greater than or less than the amount of surface enhancements shown in FIGS. 8-17. Moreover, the heat exchanger 130 may include more than one of the illustrated types of surface enhancements. For instance, any of the tube passes of the heat exchanger 130, including the first tube pass 168, may include dimples 182, protrusions 184, fins 188, or any combination thereof. Moreover, the various passes of a multi-stage heat exchanger may include different surface enhancements. For example, in a two-pass heat exchanger, a first pass may include features that extend outwards from the first pass (e.g., dimples, protrusions, and/or fins), while a second pass may include features that extend into the second pass (e.g., dimples). As another example, in a four-pass heat exchanger, the first and second passes may be the same as the first and second passes of the two-pass heat exchanger described in the last example, and the third and fourth passes may also include features that extend into the third pass (e.g., dimples). However, in any multi-stage heat exchanger, any of the passes other than first pass may not include surface enhancements. For example, in a four-pass heat exchanger, it may be the case that only the first and second passes include surface enhancements.

While only certain features and embodiments of the present disclosure have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described (i.e., those unrelated to the presently contemplated best mode of carrying out the present disclosure, or those unrelated to enabling the claimed embodiments). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A furnace system, comprising:

a burner assembly comprising a burner configured to produce a flame;

a heat exchanger comprising a plurality of tube passes, wherein the plurality of tube passes cooperatively forms a conduit for flowing combustion products generated by the burner assembly, each tube pass of the plurality of tube passes overlaps with other tube passes of the plurality of tube passes, a first tube pass of the plurality of tube passes is mechanically secured to a panel and is configured to receive the flame, and the first tube pass comprises a first plurality of surface enhancements extending radially outward from an outer surface of the first tube pass relative to a central axis of the first tube pass;

a venturi plate disposed between the burner assembly and the heat exchanger, wherein the venturi plate comprises an opening aligned with the burner and with the first tube pass, and the venturi plate is offset from the heat exchanger; and a baffle disposed within the opening and extending between the panel and the venturi plate and toward the first tube pass along the central axis of the first tube pass, wherein the baffle includes a mesh structure having a repeating U-shape with a plurality of faces, wherein the plurality of faces intersects the central axis, and wherein the baffle is configured to contact the flame and the first tube pass.

2. The furnace system of claim 1, wherein the plurality of tube passes comprises the first tube pass and a second tube pass.

3. The furnace system of claim 2, wherein the plurality of tube passes comprises a third tube pass and a fourth tube pass.

4. The furnace system of claim 1, wherein the baffle extends into the first tube pass.

5. The furnace system of claim 1, wherein the first tube pass comprises a second plurality of surface enhancements, and wherein the second plurality of surface enhancements extends radially inward from the outer surface of the first tube pass relative to the central axis of the first tube pass.

6. The furnace system of claim 5, wherein the first plurality of surface enhancements and the second plurality of surface enhancements each comprise dimples.

7. The furnace system of claim 1, wherein the first plurality of surface enhancements comprises a plurality of longitudinal fins, wherein each longitudinal fin of the plurality of longitudinal fans extends from the outer surface of the first tube pass and extends along the central axis of the first tube pass.

8. The furnace system of claim 1, wherein the first plurality of surface enhancements comprises a plurality of circular fins that extend radially outward from the outer surface of the first tube pass and circumferentially about the first tube pass relative to the central axis of the first tube pass.

9. The furnace system of claim 8, wherein the plurality of circular fins is coupled to the outer surface of the first tube pass via a mechanical securement.

10. The furnace system of claim 8, wherein the plurality of circular fins comprises a plurality of protrusions formed in an inner surface of the first tube pass.

11. The furnace system of claim 1, wherein the first plurality of surface enhancements are arranged in a staggered arrangement along the outer surface of the first tube pass.

12. A furnace heat exchanger, comprising:

a first tube pass mechanically secured to a panel and comprising an outer surface and a surface enhancement that extends radially outward from the outer surface of the first tube pass;

a second tube pass, wherein the first tube pass and the second tube pass are fluidly coupled to one another in a U-shaped configuration, and the first tube pass is configured to receive a flame and combustion products from a burner of a furnace system;

a venturi plate comprising an opening aligned with a corresponding opening of the first tube pass and with the burner of the furnace system, wherein the venturi plate is disposed between the burner and the first tube pass, and the venturi plate is offset from the first tube pass; and a baffle disposed in the opening, extending between the panel and the venturi plate, and having a mesh structure extending along a central axis of the first tube pass, wherein the mesh structure includes a repeating U-shape with a plurality of faces that intersects the central axis, and the baffle is configured to contact the flame and the first tube pass.

13. The furnace heat exchanger of claim 12, wherein the surface enhancement comprises a plurality of fins.

14. The furnace heat exchanger of claim 13, wherein each fin of the plurality of fins extends along the central axis of the first tube pass.

15. The furnace heat exchanger of claim 13, wherein each fin of the plurality of fins extends circumferentially about the central axis of the first tube pass.

16. The furnace heat exchanger of claim 12, wherein the surface enhancement comprises a first plurality of dimples extending radially outward from the outer surface of the first tube pass, a second plurality of dimples extending radially inward from the outer surface of the first tube pass, or both.

17. The furnace heat exchanger of claim 12, wherein the baffle is colocated with the flame during operation of the furnace heat exchanger, wherein the mesh baffle is configured to quench the flame.

18. A heating, ventilating, and air conditioning (HVAC) unit, comprising:

a furnace system;

a burner assembly of the furnace system, wherein the burner assembly comprises a plurality of burners, wherein each burner of the plurality of burners is configured to produce combustion products and a flame;

a heat exchanger of the furnace system, wherein the heat exchanger comprises a plurality of first tube passes secured to a panel, wherein each first tube pass of the plurality of first tube passes is configured to receive the combustion products and the flame from one burner of the plurality of burners, and each first tube pass of the plurality of first tube passes comprises a surface enhancement;

a venturi plate of the furnace system, wherein the venturi plate is disposed between the plurality of burners and the heat exchanger, wherein the venturi plate comprises a plurality of openings, wherein each opening of the plurality of openings is aligned with a respective burner of the plurality of burners and a respective first tube pass of the plurality of first tube passes, and wherein the venturi plate is offset from the heat exchanger; and a plurality of baffles of the furnace system, wherein each baffle of the plurality of baffles:

extends between the panel and the venturi plate;

is disposed in a respective opening of the plurality of openings;

extends along a longitudinal axis of a respective first tube pass of the plurality of first tube passes;

includes a mesh structure having a repeating U-shape with a plurality of faces, wherein the plurality of faces intersects the respective longitudinal axis; and is configured to contact the flame of a respective burner of the plurality of burners and contact a respective first tube pass of the plurality of first tube passes.

19. The HVAC unit of claim 18, wherein each baffle of the plurality of baffles is configured to generate infrared or radiant heat from the respective flame.

20. The HVAC unit of claim 18, wherein each first tube pass of the plurality of first tube passes is fluidly coupled to a respective second tube pass of a plurality of second tube passes by a respective U-shaped bend.

21. The HVAC unit of claim 20, wherein each second tube pass of the plurality of second tube passes is fluidly coupled to a respective third tube pass of a plurality of third tube passes by a second respective U-shaped bend.

22. The HVAC unit of claim 18, wherein the surface enhancement comprises a surface feature extending radially outward from an outer surface of the first tube pass, wherein the surface feature comprises a dimple, a longitudinal fin, a circumferential fin, or any combination thereof.

* * * * *